US008813309B2

(12) United States Patent
Friesen et al.

(10) Patent No.: US 8,813,309 B2
(45) Date of Patent: Aug. 26, 2014

(54) ROLLER HINGE CONSTRUCTIONS

(71) Applicant: Raynor Mfg. Co., Dixon, IL (US)

(72) Inventors: Raymond J. Friesen, Mississauga (CA); Surinder Sambhi, Etobicoke (CA)

(73) Assignee: Raynor Mfg. Co., Dixon, IL (US)

( * ) Notice: Subject to any disclaimer, the term of this patent is extended or adjusted under 35 U.S.C. 154(b) by 0 days.

(21) Appl. No.: 13/866,758

(22) Filed: Apr. 19, 2013

(65) Prior Publication Data

US 2013/0283565 A1 Oct. 31, 2013

Related U.S. Application Data

(63) Continuation-in-part of application No. 13/826,158, filed on Mar. 14, 2013, now abandoned, which is a continuation-in-part of application No. 13/693,679, filed on Dec. 4, 2012.

(60) Provisional application No. 61/771,552, filed on Mar. 1, 2013, provisional application No. 61/637,620, filed on Apr. 24, 2012.

(51) Int. Cl.
*E05D 15/16* (2006.01)

(52) U.S. Cl.
USPC ..... 16/91; 16/97; 16/DIG. 1; 160/201

(58) Field of Classification Search
USPC ..... 16/91, 103, 97, DIG. 1, 387, 389, 392; 160/201, 206, 210, 229.1, 236; 403/371
See application file for complete search history.

(56) References Cited

U.S. PATENT DOCUMENTS

| | | | | |
|---|---|---|---|---|
| 1,660,266 | A | 2/1928 | Horner | |
| 1,897,391 | A | 2/1933 | Kelly | |
| 1,990,870 | A | 2/1935 | Kelly | |
| 2,059,585 | A | 11/1936 | Kelly | |
| 2,827,115 | A | 3/1958 | Stroup | |
| 2,869,637 | A | 1/1959 | Schacht, Jr. | |
| 2,980,182 | A | 4/1961 | Stroup | |
| 3,060,491 | A | 10/1962 | Pemberton et al. | |
| 3,376,913 | A * | 4/1968 | Clapsaddle | 160/201 |
| 4,095,641 | A | 6/1978 | Olson | |
| 4,115,900 | A | 9/1978 | Mihalcheon | |
| 4,119,133 | A | 10/1978 | Wolf | |

(Continued)

FOREIGN PATENT DOCUMENTS

NL 278210 11/1964

OTHER PUBLICATIONS

Office Action from U.S. Appl. No. 13/693,679 mailed on Apr. 29, 2014.

*Primary Examiner* — Jeffrey O Brien
(74) *Attorney, Agent, or Firm* — Banner & Witcoff, Ltd

(57) ABSTRACT

A roller hinge assembly for connecting articulating door panels and simultaneously supporting a laterally extending panel support roller assembly includes one or more hinge units each having a male hinge strap and a female hinge strap. The structural integrity of one or more of the hinge units is supplemented by a reinforcing, slotted tubular member fitted over the roller axle support bushing which extends between and simultaneously engages opposed, spaced hinge strap arms. Two or more such hinge units may be arrayed laterally or side by side co-joined by a single hinge pin. Further, to insure appropriate alignment, a single tubular roller bushing may co-join the male or the female hinge units.

15 Claims, 4 Drawing Sheets

(56) References Cited

U.S. PATENT DOCUMENTS

| | | | | |
|---|---|---|---|---|
| 5,235,724 | A | 8/1993 | Perrin et al. | |
| 5,522,446 | A | 6/1996 | Mullet et al. | |
| 5,566,740 | A | 10/1996 | Mullet et al. | |
| 5,799,368 | A | 9/1998 | Young | |
| 5,884,363 | A | 3/1999 | Tofts | |
| 5,921,307 | A | 7/1999 | Ford et al. | |
| 5,934,352 | A | 8/1999 | Morgan | |
| 5,938,169 | A | 8/1999 | Ogawa et al. | |
| 5,954,111 | A * | 9/1999 | Ochoa | 160/201 |
| 6,006,817 | A | 12/1999 | Stone et al. | |
| 6,015,003 | A | 1/2000 | Switzgable | |
| 6,076,590 | A | 6/2000 | Ford et al. | |
| 6,082,046 | A | 7/2000 | Simmons | |
| 6,112,799 | A | 9/2000 | Mullet et al. | |
| 6,185,783 | B1 | 2/2001 | Carpinella | |
| 6,330,901 | B1 | 12/2001 | Friesen et al. | |
| 6,463,988 | B1 | 10/2002 | Mullet et al. | |
| 6,626,226 | B2 * | 9/2003 | Whitley | 160/236 |
| 6,640,872 | B1 | 11/2003 | Mullet | |
| 6,684,931 | B2 * | 2/2004 | Reimer et al. | 160/190 |
| 6,698,492 | B2 | 3/2004 | Lewis, Jr. | |
| 6,729,380 | B2 | 5/2004 | Whitley et al. | |
| 6,772,814 | B2 | 8/2004 | Leist et al. | |
| 6,843,300 | B2 | 1/2005 | Mullet et al. | |
| 6,968,886 | B2 | 11/2005 | Berry et al. | |
| 7,172,010 | B2 * | 2/2007 | Welsh | 160/201 |
| 7,178,197 | B2 * | 2/2007 | Verheye, Sr. | 16/250 |
| 7,201,207 | B2 | 4/2007 | Colston et al. | |
| 7,681,284 | B1 | 3/2010 | Schroeder | |
| 7,726,378 | B1 | 6/2010 | Savon | |
| 7,730,928 | B2 | 6/2010 | Stone et al. | |
| 7,866,368 | B2 | 1/2011 | Ostrovsky et al. | |
| 2002/0162189 | A1 * | 11/2002 | Whitley | 16/91 |
| 2004/0007334 | A1 | 1/2004 | Lewis, Jr. | |
| 2005/0011619 | A1 * | 1/2005 | Berry et al. | 160/229.1 |
| 2005/0155725 | A1 * | 7/2005 | Verheye | 160/229.1 |
| 2005/0273976 | A1 | 12/2005 | Sarver | |
| 2008/0115416 | A1 | 5/2008 | Clark | |

* cited by examiner

FIG.8
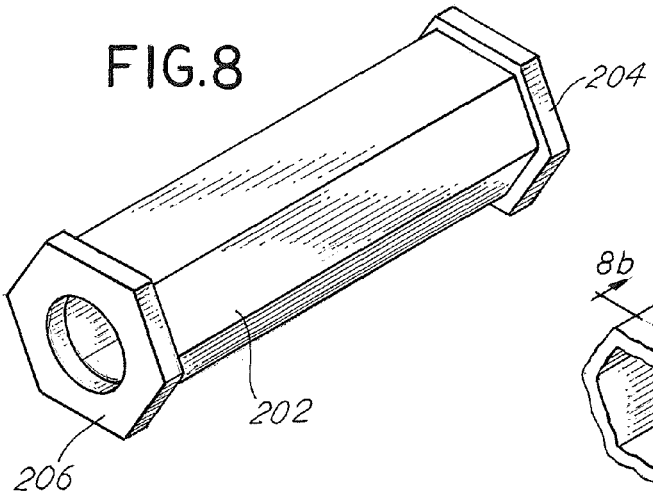
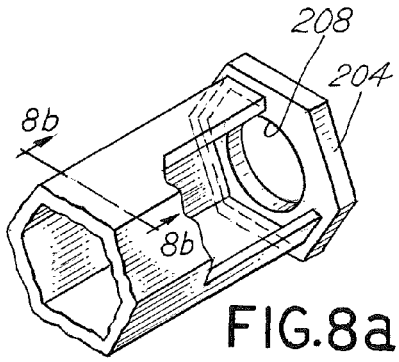
FIG.8a
FIG.8b
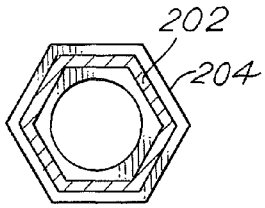
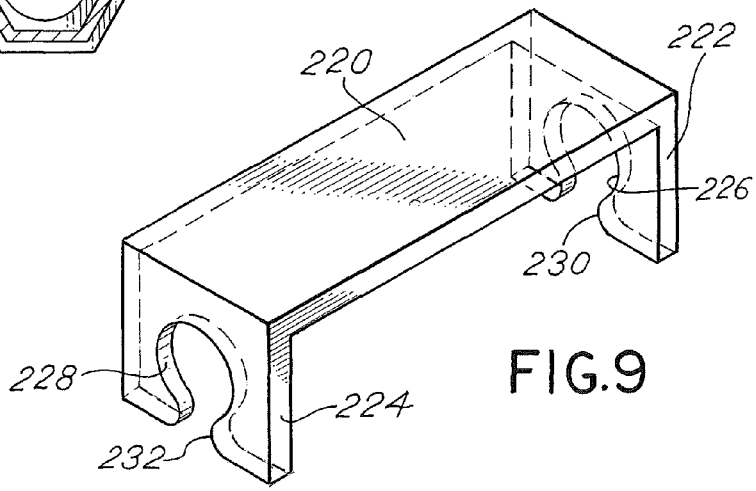
FIG.9

ROLLER HINGE CONSTRUCTIONS

CROSS REFERENCE TO RELATED APPLICATIONS

This is a continuation-in-part patent application which claims priority of utility application Ser. No. 13/826,158 filed Mar. 14, 2013 entitled "Roller Hinge Constructions" which claims priority to provisional application Ser. No. 61/771,552 filed Mar. 1, 2013 entitled "Roller Hinge Constructions" and is a continuation-in-part application incorporating by reference and claiming priority to previously filed co-pending utility application Ser. No. 13/693,679, filed Dec. 4, 2012, entitled "Double End Hinge Construction for Multiple Articulating Panel Sectional Doors" and further claims priority to and incorporation by reference to provisional application Ser. No. 61/637,620 filed Apr. 24, 2012 entitled "Double End Hinge Construction for Multiple Articulating Panel Garage Doors".

BACKGROUND OF THE INVENTION

In a principal aspect the present invention relates to a hinge construction which is typically used in combination with a multi-panel, articulating, overhead door wherein the panels are supported on rollers mounted in tracks positioned at the lateral sides of the panels.

The horizontal panels of articulating sectional doors are typically connected by hinges positioned along the horizontal edges of adjacent panels. The hinges, which are located at the lateral edges of the door panels, typically include a projecting axle with a roller mounted on a laterally projecting end of the axle. The rollers fit in a track that guide the movement of the panels as the door moves from a vertical, closed door position to an open, overhead storage position.

The hinges utilized for such constructions are the subject matter of various patents including, by way of example, U.S. Pat. No. 5,235,724 entitled "Roller-Hinge Assembly for Retractable Overhead Door" issued Aug. 17, 1993. U.S. Pat. No. 5,235,724, which is incorporated herewith by reference, discloses a typical roller hinge construction or assembly that includes an upper or male hinge strap and a lower or female hinge strap pivotally connected by means of a pintle or hinge pin. Further, the female strap may include a bushing through which an axle of a roller assembly is inserted. A roller is rotatably affixed to the end of the axle and is compatible with a track positioned laterally with respect to the side edge of the door panel.

While such hinge constructions are useful, the design of the hinge may be impacted by the position or placement of the hinge on the adjacent, horizontal door panels. That is, hinges positioned at the lateral edges are often subjected to additional stresses due to the fact that loads associated with the roller assembly are placed on the hinge in addition to the stresses associated with connecting the door panels together. In order to obviate or address such an issue, the end hinges may be oversized or multiple hinges may be positioned adjacent the lateral edges of the door. The hinges may also be arranged in a way that they are engaged or ganged together to support a roller assembly.

Nonetheless, providing hinges to address the impact of stresses at the lateral edges of doors supported by a roller track present problems. For example, the hinges may result in higher cost because of the necessity to construct them especially for the purpose of addressing increased stress. Of course, higher material costs may result in higher labor costs and also may result in problems of installation inasmuch as the hinge assemblies are distinct and must be carefully assembled in order to provide necessary alignment. Thus, not only the cost of materials, but the cost of installation may be higher.

In addition, there may be structural disadvantages unless the hinges are properly aligned and carefully installed. Failure to carefully install such hinges may result in premature degrading of the door panels, or the roller guide track or the rollers and the assembly associated with support of the doors along their lateral edges. A manifestation of the stress placed upon a roller hinge is illustrated in FIG. 1. That is, the hinge arms, which support a bushing for receipt of an axle of a roller assembly, may become distorted in the manner depicted in FIG. 1 because the bushing in combination with the spaced bushing support arms is structurally inadequate to prevent the support arms from bending. For the various reasons described, an improved roller hinge design is desired.

SUMMARY OF THE INVENTION

Briefly, the present invention comprises a roller hinge assembly for connecting articulating door panels and simultaneously supporting a laterally extending panel support roller. The hinge assembly may comprise the utilization of multiple uniformly sized hinges each having a male hinge strap or leaf and a female strap or leaf Two or more such uniformly sized hinges may be arrayed laterally or side by side one with respect to the other and co-joined by means of a single pin or pintle. Further, to insure appropriate alignment of the assembled hinges, a single tubular roller bushing may be employed to co join the arrayed hinges and simultaneously serve as a single elongate housing for a roller axle. The tubular bushing, as well as the pintle or hinge pivot pin, when fastened or attached to the assembly of two or more hinges, insures that the hinges will remain joined together forming a composite hinge, assembly which provides uniform alignment and movement of the hinge leafs with respect to each other and also simultaneous, parallel alignment of the pivot axes of the hinge leaves and the bushing for the roller axle that is fitted through the tubular bushing of the hinges.

The conjoined hinges may be substantially identical or distinct in various respects. For example, adjacent hinge leaves may have a common hinge pin axis with a single hinge pin and a common roller bushing axis for receipt of a roller axle. Alternatively each hinge may include a reinforcement member affixed to its own roller bushing. Conjoined hinges may each include reinforcement members affixed to their respective roller bushings or a unitary roller bushing. That is, an aspect of the invention is to provide axle bushing reinforcements for one or more roller support hinges. Such axle bushing reinforcement members typically comprise a longitudinally slotted, generally tubular member fitted over an axle bushing of a single hinge with the tubular member extending between the axle bushing support arms of the hinge. A feature of the generally tubular, slotted reinforcement member is the capability to be inserted onto or snapped onto an axle bushing thus facilitating the assembly of and creation of a strengthened hinge.

Thus, an aspect of the invention is to provide a single size hinge assembly which may be utilized as a unitary hinge or compounded with other identical hinge assemblies using a single, common axle bushing to join and maintain together the compound hinge assemblies which may then be used to support a panel roller.

Another object and aspect of the invention is to provide a single standard hinge assembly, which has lower manufacturing and installation costs, but may be utilized as a single component or as part of a multicomponent hinge assembly.

A further aspect of the invention is to provide a hinge assembly which may include two or more standard hinge units wherein each unit is designed to be fastened to adjacent panels of a multi-panel sectional door to thereby insure complete and safe attachment and alignment of the panels and thus improve structural integrity and distribute the stresses associated with supporting the panels by means of a roller hinge assembly.

Another object, feature and aspect of the invention are to provide a basic or modular hinge construction which is capable of modification to provide augmented structural integrity.

These and other objects, aspects, advantages and features of the invention will be set forth in the detailed description which follows.

BRIEF DESCRIPTION OF THE DRAWING

In the detailed description which follows, reference will be made to the drawing comprised of the following figures:

FIGS. 8, 8*a*, 8*b* and 9 depict various views of alternative reinforcing members.

DESCRIPTION OF EMBODIMENTS OF THE INVENTION

Figure 1:
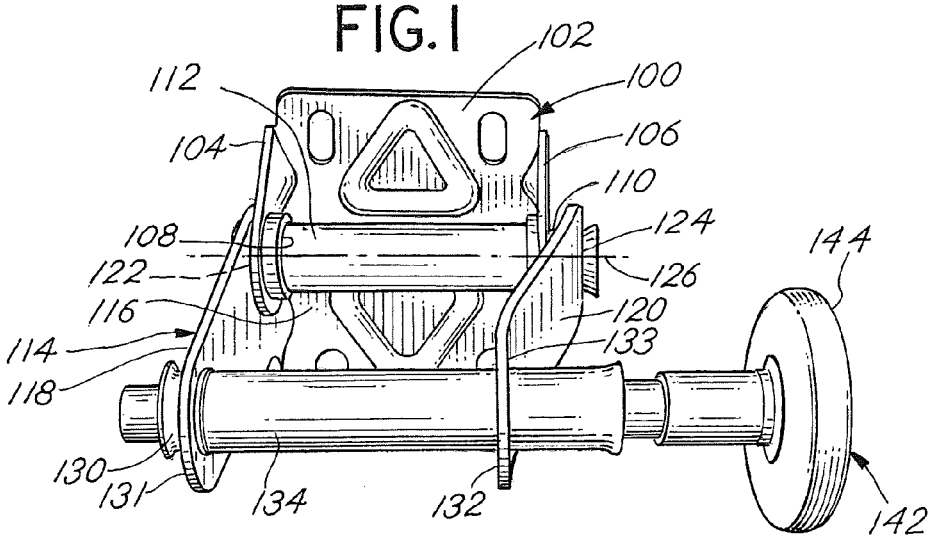
FIG. 1 is an isometric view of a hinge assembly comprised of first and second hinge leaves pivotally joined by a hinge pin wherein one of the leaves includes a roller axle bushing having an axis generally parallel to the hinge pin and wherein the roller axle bushing is supported by spaced arms extending transversely from a hinge base, but wherein a load from the roller axle assembly or other stress has caused the spaced arms to become distorted.

FIG. 1 depicts a single roller hinge assembly for supporting an axle roller. The hinge has been distorted or damaged due to stresses placed on the lateral arms of the hinge that extends transversely from a hinge base 102. The single hinge construction of FIG. 1 includes a first or male leaf 100 having a base 102, a first arm 104 and a spaced second arm 106. The arms 104, 106 are transverse or normal to the base 102. The leaf 100 may thus be formed by a stamping process from a metal sheet. The arms 104 and 106 are spaced from one another and extend from opposite sides of the base 102. The arms include aligned openings 108 and 110 which are designed to receive a hinge pin or pintle 112.

A second or female leaf 114 includes a base 116, a first arm 118 and a spaced second arm 120. The arms 118 and 120, in their manufactured condition, extend transversely from the base 116 and are spaced from one another by the width of the base 116. The arms 118 and 120 include throughpassages which are aligned with the passages 108 and 110 for receipt of the pintle or hinge pin 112 which joins together the leaves 100 and 114 for rotation about an axis 126. The separate leaves 100 and 114 are nested or pivotally joined by a hinge pin 112 and may be affixed to (by way of example) abutting horizontal panels of a sectional garage door.

Figure 5:
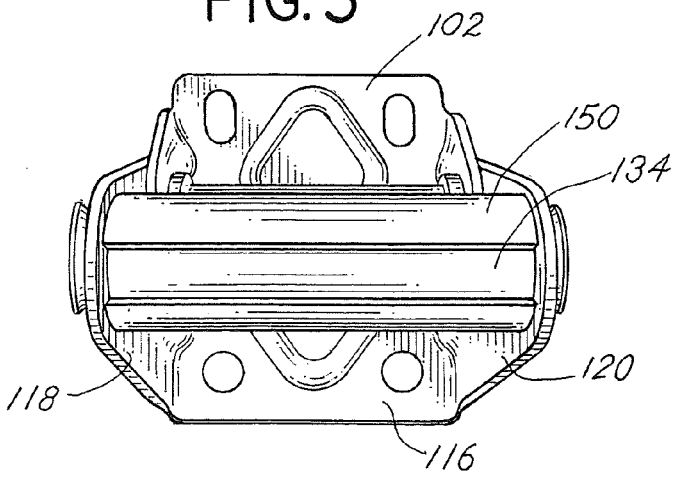
FIG. 5 is an isometric view of a reinforcement member as depicted in FIGS. 4*a* and 4*b* incorporated in a single roller hinge.

As depicted in FIG. 5 the leaves 118 and 120 further include aligned passages 130 and 132 for receipt of a bushing 134 that is affixed at its opposite ends by being formed over the outside face 131 and 133, respectively, of the leaves 118 and 120. The bushing 134 is designed to receive the axle 140 of a roller assembly 142 having an end roller 144 designed to be inserted into and move in a track of a sectional door such as a garage door comprised of multiple horizontal, rectangular panels.

As illustrated in FIG. 1, the second hinge leaf 114 and more particularly the arms 118 and 120 are distorted by the loads placed thereon through the axle 140 and the roller 142. That is, an end or outer flange 133 associated with the tube 134 is restrained in its movement. However, the opposite arm 118 will not restrain the movement of the bushing 134 to the left in FIG. 1 inasmuch as a retention flange 131 is positioned on or against the outside face or surface of the leaf 118. Thus, an axial and/or radial load on the roller 142 is transferred to the bushing 134 and the arms 118 and 120 may cause distorting as depicted in FIG. 1.

Figure 4B:
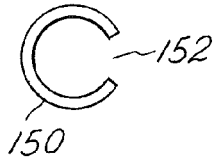
FIG. 4*b* is an end view of the reinforcement member of FIGS. 4*a* and 4*b;*
Figure 4A:
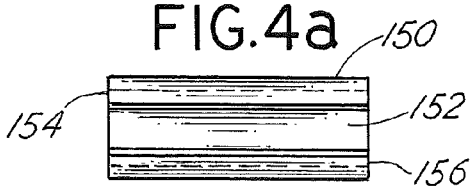
FIG. 4*a* is a plan view of a slotted tubular axle bushing reinforcement member for a single roller axle bushing of a single hinge.

To overcome this potential for distortion and bending, a reinforcement mechanism as depicted in FIGS. 4*a* and 4*b* is incorporated into the hinge construction depicted in FIG. 1. This is depicted in FIG. 5. The reinforcement mechanism comprises a second generally tubular member 150 as illustrated in FIGS. 4*a* and 4*b* having an inside diameter which typically is slightly greater than the outside diameter of the bushing 134 and which further includes a longitudinal slot 152 that extends from a first end 154 through a second end 156 of the member 150. The slot 152 has a width dimension which is less than the outside diameter of the bushing 134. Thus, the member 150 may be fitted over and onto the bushing 134 and against the bushing 134 to be retained thereon. Importantly, the dimension between the ends 154 and 156 of the bushing 150 is approximately equal to the design width of the space between the opposed inside faces of the arms 118 and 120. Thus, the member 150 will provide for mechanical engagement of the opposite ends 154 and 156 against the inside surfaces of the arms 118 and 120 to thereby enable both of the arms 118 and 120 to participate in load bearing associated with axial and/or radial forces on the axle roller and, more particularly, the axle 137 within the bushing 134.

FIG. 5 thus illustrates in greater detail the reinforcing member 150 positioned between the arms 118 and 120 and, more particularly, in a manner which provides that the reinforcing member 150 will fit against the inside surfaces of the arms 118 and 120. Thus, by fitting or snapping the reinforcement member 150 over the bushing 134, the load associated with the roller assembly will be shared by both arms 118 and 120. As a consequence, the hinge itself can tolerate increased loads and thus be used for larger sectional doors employing a roller hinge assembly. Note that typically the bushing 134 is to be mounted on the female hinge leaf.

Figure 6:
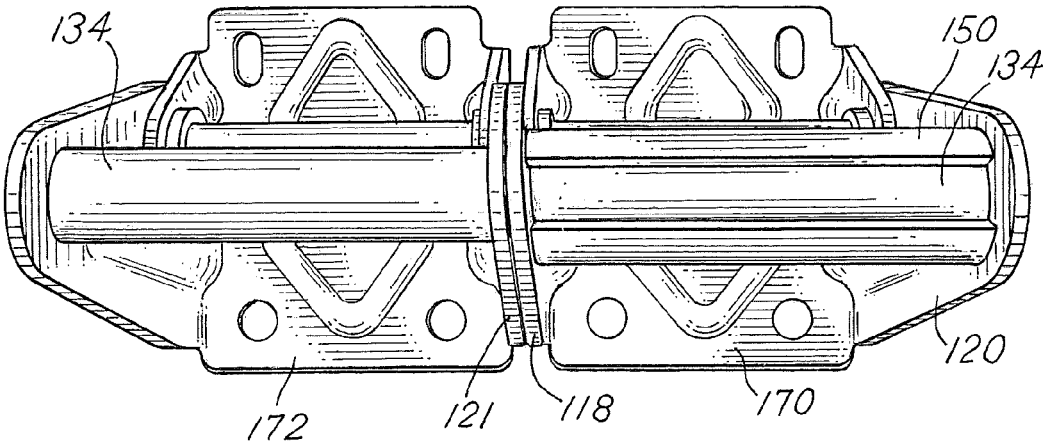
FIG. 6 is an isometric view of a single reinforcement member as depicted in FIGS. 4*a* and 4*b* incorporated in an array of two single roller hinges.

FIG. 6 illustrates a further embodiment. In FIG. 6, a first hinge 170 is arrayed in combination with a second hinge 172. The first hinge 170 employs the reinforcing member 150 mounted on a bushing 134. The hinges 170 and 172 are positioned so that their respective arms 118 and 121 abut one another. In this manner, the hinge 170, in combination with the second hinge 172 provides that three arms; namely, the arms 118, 120 and 121, in combination, will resist any distortion associated with the forces or loads from a roller assembly 142 through the associated tubular members 134 of the separate hinges 170 and 172. Thus, three arms share the load; namely, arms 118, 120 and 121.

Figure 7:
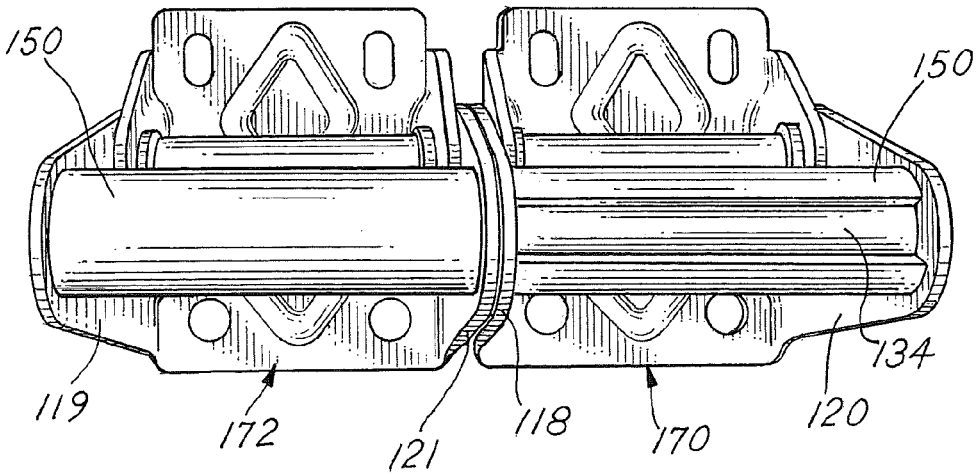
FIG. 7 is an isometric view of a pair of reinforcing members as depicted in FIGS. 4*a* and 4*b* incorporated in a double hinge assembly.

FIG. 7 illustrates yet a further embodiment wherein the insertion of a reinforcement member 150 is positioned over and upon the bushing tube 134 of each of the two adjacent hinges 170 and 172. In this circumstance, the arms 118, 120, 119 and 121 provide an increased load capacity for the hinge array.

The hinge assembly of FIG. 7 comprises an array wherein the separate hinges 170 and 172 are not conjoined. Alternatively, the hinges 170 and 172 can be conjoined in the manner described with respect to FIGS. 2 and 3. As a consequence of the design, the hinges which are utilized for the purpose of a connecting sectional door panels, may all be manufactured having the same size and design, but optionally including reinforcing members 150, and conjoined as described hereinafter or not cojoined. The number of such hinge combinations including the arrangement of the inclusion of reinforcing members 150 and the utilization of cojoinder may be varied to provide the most cost effective and efficient hinge constructions utilizing a minimum number of component parts.

Figure 2:
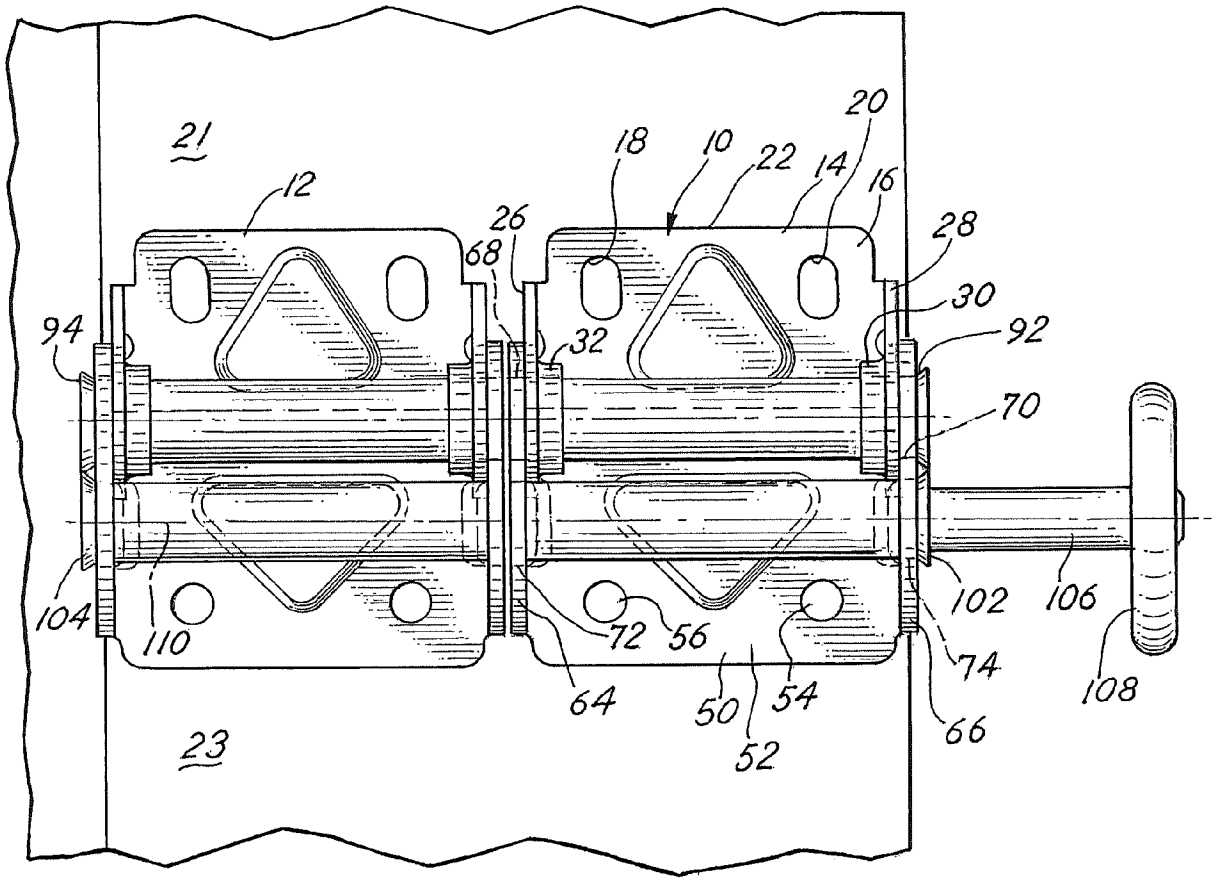
FIG. 2 is a top plan view of a composite hinge assembly incorporating two uniformly sized hinge units coupled by a single hinge pin or pivot pin or pintle and further coupled by a tubular bushing, both of which are fixed or pinned to the adjacent hinge units in a manner which couples the hinges and insures their alignment.
Figure 3:
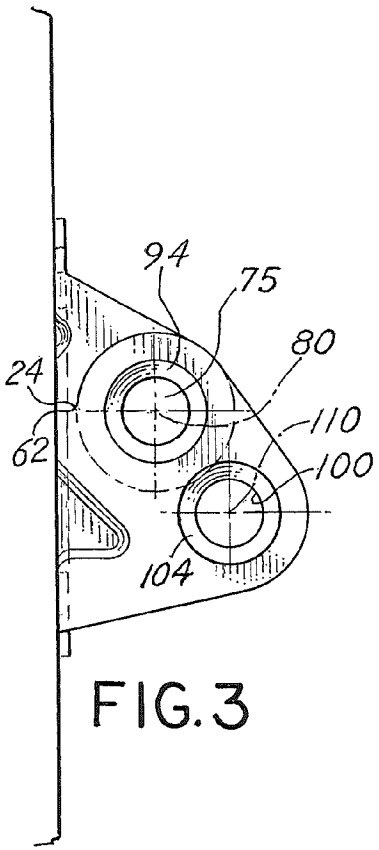
FIG. 3 is an end view of the assembly of FIG. 2.

Referring to FIGS. 2 and 3, a conjoined multiple unit hinge assembly embodiment includes a first hinge unit 10 and a substantially identical second hinge unit 12. Thus, a description of the first hinge unit 10 is generally applicable to the second hinge unit 12 except to the extent the units are conjoined.

The first hinge unit 10 includes a planar, generally rectangular base 14 associated with a male hinge strap 16. The base 14 includes elongated fastener openings 18 and 20 to permit adjustment of the positioning of the hinge when it is attached by fasteners to a sectional door panel 21. The male hinge strap 16 further includes a front edge 22 and a back edge 24. The front edge 22 and the back edge 24 are generally parallel in the embodiment shown. Further, the male hinge strap 16 includes first and second transversely, upwardly extending support arms 26 and 28 at the opposite lateral sides of the base 14. The arms 26 and 28 are generally parallel and spaced one from the other. They each include a hinge pin or pintle passageway 30 and 32, respectively, formed therein. The openings 30 and 32 are aligned and define an axis 80 parallel to base 14. The upwardly extending support arms 26 and 28 are generally mirror images of each other.

The assembly or hinge unit 10 further includes a female hinge strap 50 with a base 52 having fastener openings 54 and 56. Strap 50 further includes first and second spaced parallel, support arms 64 and 66 that extend transversely upwardly, normal to base 52. The support arms 64, 66 include aligned hinge pin or pintle passages 68 and 70. Further, the arms 64 and 66 include aligned openings 72 and 74 for receipt of a tubular, axle bushing 100 described hereinafter.

The transverse arms 64 and 66 are spaced to slidably receive the arms 30 and 32 of the male hinge strap 16. Thus, the male hinge strap 16 may be articulated about axis 80 when the passages or openings 30, 32, 68 and 70 of the respective hinge straps 16 and 50 receive a hinge pin or pintle 75 to enable articulation. Adjacent, parallel sectional door panels 21, 23 are joined by the attached hinge straps 16, 50 fastened respectively to the adjacent panels 21, 23. The axis 80 of rotation of the hinge straps 16 and 50 and is defined by the center line axis of pin or pintle 75 which is fitted through the openings 68, 70, 30 and 32.

The passages 72, 74 of the respective hinges or hinge units 10 and 12 are also aligned and include a tubular bushing 100 extending therethrough along an axis of rotation 110. Bushing 100 is keyed or held in position by crimping 102 and 104 at the opposite ends. The tubular bushing 100 receives a shaft or axle 106 of a roller assembly having an end roller 108.

The second hinge assembly 12 is substantially identical to the first hinge assembly 10 in the embodiment depicted. Thus, the openings defining the axis 80 are aligned and the pintle or hinge pin 75 is inserted through those openings and keyed or formed at its opposite ends with a crimp 92 and 94 which holds the adjacent hinge leaves or hinge straps or units 10 and 12 joined together. As a result of this construction, the hinge units 10 and 12 are held together by pintle 75 and bushing 100 that each extend longitudinally along a first axis 80 and a second parallel axis 110 respectively. The parallel axes 80 and 110 insure uniform alignment of the hinge units 10, 12 and further because the pintle 75 and bushing 100 are crimped at their opposite ends, the hinge units 10 and 12 together, form a compact, easily manufactured assembly. That is, the pintle 75 and bushing 100, when so formed, enable adjacent support arms of adjacent female straps to be maintained in abutting relationship. The joiner of the hinge units 10, 12 is thus easily manufactured.

Also, more than two hinge units 10, 12 may be assembled as described. Further, the construction of hinge straps may be reversed to the extent that the unit 16 may be constructed as the female element and the unit 50 constructed as the male element. Additionally the reinforcing member 150 strengthens the hinge construction even in the circumstance where the bushing 134 includes flanges at each end that face the inside and outside surface of the arms such as 118 and 120. This results since the reinforcing member typically engages the inside surface of each arm at a greater radial distance from the centerline axis of the bushing 134. This effect may be enhanced by flanges on the opposite ends of reinforcing member 150.

Numerous other alternative constructions may be employed to accomplish the objectives of the invention. For example, the substantially parallel arms, such as arms 118 and 120, may be reinforced against distortion from loads by placing a cylindrical member with or without an axial slot between the ends of the reinforcing member. That is, the pintle associated with the hinge leaf may, during assembly, be inserted through a reinforcing member inserted in axial alignment with the opposed openings through the arms, which openings receive the pintle or hinge pin. The reinforcing member may typically have a cylindrical configuration through which the pintle may be inserted. Importantly, the opposite ends of the reinforcing member should abut in a snug manner the inside surfaces of the opposed arms, for example, arms 118 and 120 as previously described. The cross sectional configuration of the reinforcing member may be varied. For example, it may have a hexagonal shape, a pentagonal shape or other shapes which fit around the pintle. Further, the reinforcing member may include or exclude an elongate slot to facilitate placement thereof on the pintle after it is inserted through the opposed generally parallel arms, 118 and 120 by way of example. Alternatively, the reinforcing member may be placed, as described above, during the assembly of the pintle by insertion through appropriate aligned openings in the arms. Flanges may be positioned on the reinforcing member, either extending radially outward or radially inwardly or radially in both directions will also provide a means to increase load capacity of the assembly.

FIGS. 8, 8*a*, 8*b* and 9 illustrate examples of various alternate constructions. Thus, as shown in FIG. 8, a tubular member 202, which in the instance depicted, has a hexagonal cross sectional figuration as depicted in FIG. 8*b* includes a first flange 204 attached at one end and a second flange 206 at the opposite end. FIG. 8*a* is a partial cutaway, isometric view of the tubular member of FIG. 8. FIG. 8*b* is a cross sectional view taken along the line 8*b*-8*b* in FIG. 8*a*. Each flange, such as flange 204, includes a circular opening 208 which is designed to be positioned around the lower axle bushing of a hinge. The longitudinal dimension of the tubular member of FIG. 8 is designed to position the flanges 204 and 206 against the opposed faces or surfaces of the transverse support arms of a hinge. The size and shape of the flanges 204 and 206 may be adjusted to further allocate the load placed upon the transverse arms. The tubular member 202 and flanges 204 and 206 may include a longitudinal slot to facilitate positioning of the tubular member over the roller axle bushing.

FIG. 9 depicts yet another alternative construction wherein the tubular member has a construction comprised of a longitudinal plate 220 extending between two transversely projecting flanges 222 and 224. The flanges 222 and 224 include, respectively, openings 226 and 228 which are sized to fit over a roller axle bushing by way of example. Because the openings 226 and 228 include slots 230 and 232, the member depicted in FIG. 9 may be inserted over and fitted onto a bushing.

Further, the material utilized for the reinforcing members may vary. For example, cast or stamped metal or polymeric materials, alone or in combination, may be utilized. Thus, the invention is directed to a reinforcing member which may be constructed or formed in any of a multiplicity of designs which interact in some fashion or another with the opposed arms by providing support for additional loads which resist the axial and/or radial forces imposed on the hinge assembly, and in particular, the arms that receive the pintle or a hinge pin. Various features of the embodiments may be modified without altering the scope of the invention. While embodiments of the invention have been described, the invention is limited only by the following claims and equivalents.

What is claimed is:

1. A roller hinge assembly for connecting articulating door panels and supporting a laterally extending door panel, support axle, and roller comprising:

a first and second roller hinge unit, each unit including a male hinge strap and a female hinge strap, said male hinge strap and said female hinge strap each including a generally planar base, each base including a front base edge, a back base edge and first and second spaced, generally parallel, transverse support arms extending from each said base, each arm having an inside face and an outside face; said male strap and said female strap support arms each including generally aligned hinge pintle openings, the support arms of one of said female strap and said male strap further including generally aligned roller axle bushing openings, said male and female strap hinge pintle openings of said first and second roller hinge units axially aligned and said axle bushing openings of said first and second roller hinge units axially aligned, with opposed, abutting support arms;

a single pintle extending through the aligned pintle openings, said pintle rotatably maintaining said first and second units joined together and pivotal about a common pintle axis;

a generally tubular, roller axle bushing extending through the aligned roller axle bushing openings of at least one of said transverse support arms of at least one hinge unit; and a second generally tubular member fitted over the roller axle bushing and extending generally between the transverse support arms of the at least one hinge unit in substantial simultaneous engagement with the inside face of said support arms of the male hinge strap of the at least one hinge unit.

2. The hinge of claim 1 wherein the roller axle bushing is generally cylindrical and the second tubular roller member is cylindrical with an inside diameter generally equal to the outside diameter of the roller axle bushing.

3. The hinge of claim 2 wherein the second tubular member includes a slot extending the axial length of the second roller member.

4. The hinge of claim 3 wherein the slot is a straight axial slot.

5. The hinge of claim 1 wherein the roller axle bushing includes flanges at the opposite ends thereof fitted against the outside face of said arms.

6. The hinge of claim 2 wherein the roller axle bushing includes flanges at the opposite ends thereof fitted against the outside face of said arms.

7. The hinge of claim 3 wherein the roller axle bushing includes flanges at the opposite ends thereof fitted against the outside face of said arms.

8. The hinge of claim 4 wherein the roller axle bushing includes flanges at the opposite ends thereof fitted against the outside face of said arms.

9. The hinge of claim 1 further including a roller axle in said roller axle bushing.

10. A roller hinge for connecting articulating door panels and supporting a laterally extending door panel, support axle, and roller comprising:

a roller hinge unit including a male hinge strap and a female hinge strap, said male hinge strap and said female hinge strap each including a base, each base including a front base edge, a back base edge and first and second spaced, generally parallel, transverse support arms extending from each said base, each arm having an inside face and an outside face; said male strap and female strap support arms each including generally aligned hinge pintle openings, the support arms of one of said female strap and said male strap further including aligned roller axle bushing openings, said male and female strap hinge pintle openings axially aligned and said axle bushing openings axially aligned;

a pintle extending through the aligned pintle openings, said pintle pivotally maintaining said straps about a common pintle axis;

a generally tubular, roller axle bushing extending through the aligned roller axle bushing openings; and a second generally tubular reinforcing member fitted over the roller axle bushing and extending generally between the transverse support arms in substantial simultaneous engagement with the inside face of said support arms of the male hinge strap.

11. A roller hinge assembly for connecting articulating door panels and supporting a laterally extending door panel, support axle, and roller comprising:

at least a first and second roller hinge unit, each unit including a male hinge strap and a female hinge strap, said male hinge strap and said female hinge strap each including a base, each base including a front base edge, a back base edge and first and second spaced, generally parallel, transverse support arms extending from each said base, each arm having an inside face, said male strap and female strap support arms each including aligned hinge pintle openings, the support arms of one of said female strap and said male strap further including aligned roller axle bushing openings, said male and female strap hinge pintle openings of said first and second roller hinge units generally axially aligned and said axle bushing openings of said first and second roller hinge units generally axially aligned, with opposed abutting support arms;

a pintle extending through the aligned pintle openings, said pintle rotatably maintaining said first and second units joined together and pivotal about a common pintle axis;

a generally tubular, roller axle bushing extending through the aligned roller axle bushing openings of at least one of said transverse support arms of at least one hinge unit; and a second generally tubular member fitted over the roller axle bushing and extending generally between the transverse support arms of the at least one hinge unit in substantial simultaneous engagement with the inside face of said support arms of the male hinge strap of the at least one hinge unit.

12. The roller hinge assembly of claim 11 wherein the roller axle bushing is a single roller axle bushing extending through the aligned roller axle bushing openings of the first and second hinge units.

13. The roller hinge assembly of claim 1 wherein the units are adjacent with the bushing openings in the female hinge straps and wherein one arm of each said female strap abuts one arm of the adjacent female hinge strap.

14. The roller hinge assembly of claim 11 wherein the units are adjacent with the bushing openings in the female hinge straps and wherein one arm of each said female strap abuts one arm of the adjacent female hinge strap.

15. The roller hinge assembly of claim 12 wherein the units are adjacent with the bushing openings in the female hinge straps and wherein one arm of each said female strap abuts one arm of the adjacent female hinge strap.

* * * * *